US010392749B2

(12) United States Patent
Sorrentino et al.

(10) Patent No.: US 10,392,749 B2
(45) Date of Patent: Aug. 27, 2019

(54) YANKEE DRYER CYLINDER WITH CONTROLLED THERMAL EXPANSION

(71) Applicant: A. CELLI PAPER S.P.A., Capannori (IT)

(72) Inventors: Salvatore Sorrentino, Pinerolo (IT); Guiseppe Antonini, Viareggio (IT)

(73) Assignee: A. CELLI PAPER S.P.A., Capannori (IT)

( * ) Notice: Subject to any disclaimer, the term of this patent is extended or adjusted under 35 U.S.C. 154(b) by 28 days.

(21) Appl. No.: 15/557,554

(22) PCT Filed: Mar. 9, 2016

(86) PCT No.: PCT/IB2016/051319

§ 371 (c)(1),
(2) Date: Sep. 12, 2017

(87) PCT Pub. No.: WO2016/142868

PCT Pub. Date: Sep. 15, 2016

(65) Prior Publication Data

US 2018/0058005 A1 Mar. 1, 2018

(30) Foreign Application Priority Data

Mar. 12, 2015 (IT) ..... PI2015A0018

(51) Int. Cl.
*D21F 5/02* (2006.01)
*D21F 5/18* (2006.01)

(52) U.S. Cl.
CPC ..... *D21F 5/021* (2013.01); *D21F 5/181* (2013.01)

(58) Field of Classification Search
CPC ..... D21F 5/021; D21F 5/181
See application file for complete search history.

(56) References Cited

U.S. PATENT DOCUMENTS 3,318,423 A * 5/1967 Dunki ..... C22C 37/00
188/251 M

FOREIGN PATENT DOCUMENTS

DE 10 2013 213 197 A1 1/2015
WO 2008/105005 A1 9/2008

OTHER PUBLICATIONS

International Search Report, dated Jun. 2, 2016, for Application No. PCT/IB2016/051319.

* cited by examiner

*Primary Examiner* — Jessica Yuen
(74) *Attorney, Agent, or Firm* — Ladas & Parry LLP; Malcolm J. MacDonald

(57) ABSTRACT

Yankee dryer cylinder (1) having a cylindrical shell made of steel (10), having a first and a second end opposite each other (11, 12) and provided with a plurality of circumferential grooves (15). The cylinder (1) includes a first and a second head (20, 30) made of cast iron and fixed respectively to the first and to the second end (11, 12) of the cylindrical shell made of steel (10). It is, furthermore, provided a hollow shaft (40) mounted inside the cylindrical shell (10) and connected to the first and to the second head (20, 30) at a first and a second end (41, 42), respectively. The cylinder is also provided with a first and a second bearing journal (50,60) fixed to the hollow shaft (40) at a respective end (41, 42).

8 Claims, 2 Drawing Sheets

YANKEE DRYER CYLINDER WITH CONTROLLED THERMAL EXPANSION

FIELD OF THE INVENTION

The present invention relates to the field of machines for producing paper and similar products and in particular relates to a structure of Yankee dryer cylinder, also known as "Yankee Cylinder", having a controlled thermal expansion.

STATE OF THE ART

As well known, the plants for producing paper use a headbox for distributing on a forming fabric a mixture of cellulosic fibres and water, and sometimes additives of different kinds. This way, a determined amount of water is drained by the centrifugal force, thus increasing the dry content of the layer of the mixture that is present on the forming fabric.

The content of water is, then, reduced, through a series of steps between more tele and/or felts of the mixture layer, up to obtain a consistency that allows the passage through a drying section. This usually comprises at least a Yankee dryer cylinder, also called "yankee cylinder" and a drying hood fed with hot air. In particular, the web of treated wet paper is laid on the external surface of the Yankee cylinder, whilst the inside of the Yankee dryer cylinder is heated by introducing steam. The steam produced inside the Yankee dryer cylinder dell' hot air that is blown by the drying hood on the paper causes the web of wet paper that is laid on the external surface is gradually dried. When the desired value of drying is achieved, the web of paper is removed from the external surface of the Yankee dryer cylinder by means of a blade, or doctor blade. This removal allows to obtain, using suitable techniques, crepe paper, or smooth paper.

As known, a Yankee dryer cylinder essentially comprises two heads, or end walls, between which a cylindrical shell is positioned. To each head, a bearing journal is fixed that is mounted, in operating conditions, on a respective bearing. A hollow shaft is provided inside the shell. The heads are usually provided with inspection apertures made on the body of the heads and closed with suitable lids fixed by means of screw bolts to the heads.

The constitutive components of the Yankee cylinder, i.e. the heads, the shell, the bearing journals etc. are obtained by melting of cast iron and are fixed by means of screw bolts.

Yankee cylinders are also provided made of steel in which each head is fixed to the cylindrical shell by a weld bead (see about that WO2008/105005). However, also this kind of Yankee cylinders has a lot of drawbacks.

Firstly, before fixing by welding the head to the shell, it is necessary to submit the surfaces where the weld beads will be made to a series of preliminary workings.

At the end of the above mentioned workings, at the surfaces where the weld bead will be made, a reduction in the thickness is produced and, therefore, the head has a thickness that is not uniform. As a consequence of above, the structure of the head at the zones having the reduced thickness results to be strongly weakened. The presence of zones having a higher thickness alternate to zones having a lower thickness, in operating conditions, causes that the stresses, to which the heads are subjected, are not uniform.

Furthermore, in the case of welded heads, the production cycle provides a lot of annealing cycles, normally 2 annealing cycles, increasing the costs due to the mass of the products.

More in detail, as known, in operating conditions, the Yankee cylinders are subjected to high stresses, mainly thermos-elastic stresses, pressure stresses and to the stresses produced by the centrifugal force. In particular, the highest values both of the thermos-elastic stresses and of the pressure stresses concentrate at the welding, that are, therefore, the weakest areas of the whole structure of the Yankee cylinder.

This implies a short life of the Yankee dryer cylinder and the need to frequently carry out periodical controls both on the surface that in the depth in order to verify that the weld bead has been carried out correctly and for avoiding the presence and/or the beginning of cracks during the operating conditions. More in detail, the pressure that is exerted by the steam can, over time, alter the structure of the head, in particular if the head is of flat kind and is welded, and causes, therefore, cracks at the weld beads.

In addition to the above indicated advantages, due to the irregular geometry of the heads, the above mentioned preliminary working are particularly complex and therefore needs long times for being carried out besides, it increases the costs, the workings that has to be carried out, the transport costs and the energy consumption.

In order to try to overcome the above mentioned drawbacks both of the Yankee cylinders wholly made of cast iron and of the Yankee cylinders wholly made of steel some "hybrid" solutions have been proposed, that means Yankee cylinders comprising a cylindrical shell made of steel and the heads, the bearing journals and the hollow shaft made of cast iron.

Nevertheless, the solutions that have been proposed have many drawbacks.

In fact, due to the different behaviour of the cast iron and of the steel that are used, in operating conditions, in particular from a point of view of the thermal expansion, high stresses are produced inside the structure of the Yankee dryer cylinder. This is mainly due to the fact that the cast iron that is normally used for the heads of this kind of products has a thermal expansion coefficient that is significantly different from the thermal expansion coefficient of the steel that are used for the shell.

An example of a Yankee dryer cylinder of prior art having the above mentioned drawbacks is disclosed in DE102013213197.

SUMMARY OF THE INVENTION

It is then an object of the present invention to provide a Yankee cylinder, or Yankee dryer cylinder, of mixed type steel and cast iron that is able to overcome the above mentioned drawbacks of the Yankee cylinders of prior art.

It is also an object of the present invention to provide a Yankee dryer cylinder of mixed type steel and cast iron that is able to assure a high structural stability and an optimum working, when it is subjected to thermal stresses.

These and other objects are achieved by a Yankee cylinder, or Yankee dryer cylinder, according to the present invention, comprising:

- a cylindrical shell made of steel having a first end and a second end opposite to the first end, said cylindrical shell having a longitudinal axis and being, furthermore, provided with a plurality of circumferential grooves;
- a first head, or end wall, that is fixed to the first end of the cylindrical shell made of steel, said first head being made of cast iron;

a second head, or end wall, fixed to the second end of the cylindrical shell made of steel, also the second head being made of cast iron;

a hollow shaft mounted inside the cylindrical shell and connected to the first and to the second head at a first and a second end, respectively;

a first bearing journal that is fixed to the hollow shaft at a first end;

a second bearing journal fixed to the hollow shaft at of the second end;

whose main characteristic is that the cast iron of which the first and the second head are made has the following composition by weight %:

C: between 3.0 and 3.5%;
Si: between 1.5 and 2.7%;
Mn: between 0.3 and 0.7%;
P: between 0.05 and 0.10%;
V: between 0.20 and 0.50%;
S: between 0.05 and 0.10%;
Mg: between 0.06 and 0.20%;
Cu: between 0.10 and 0.80%;
Cr: between 0.05 and 0.10%.

In particular, the total percentage of all the non-ferrous components is set between 5.2 and 6.9% by weight %.

Advantageously, the hollow shaft is made of the same cast iron in which the first and the second head are made.

Preferably, the first and the second bearing journal are made of the same cast iron in which the first and the second head are made, i.e. a cast iron having the same composition by weight % of the cast iron of the first and of the second head.

In particular, each head is fixed to a respective end of the cylindrical shell by means of a bolting.

The selection of a cast iron having the above indicated composition, in particular a spheroidal cast iron, as material for producing the heads, and possibly also the journal bearings and the hollow shaft, allows to optimize the working of the Yankee dryer cylinder because this particular type of cast iron, in the temperature range in which the Yankee cylinder works, has a thermal expansion, in particular a trend of the linear thermal expansion, that is similar to that one of the steel that is used, in particular steel SA-516-70. Therefore, with respect to the known "hybrid" Yankee cylinders of prior art, the Yankee dryer cylinder according to the present invention is able to reduce, up to cancel, the stresses due to the different thermal expansion of the different materials in operating conditions.

In particular, each head comprises:

a central lowered portion towards the inside of the Yankee cylinder;

an end portion connected to the central lowered portion through a connection portion.

The connection portion can be substantially flat, or substantially concave.

In particular, at the connection portion of a head at least an inspection aperture can be provided for example 2 inspection apertures. These assure that, during the assembly, or the maintenance operations, the staff can work in safety.

In a possible embodiment, each connection portion of each head is provided with 2 inspection apertures arranged at 180°.

In particular, each inspection aperture has a tubular shape. The tubular shape of the inspection apertures allows to simplify and to improve the dynamic balancing of the whole structure and to help the staff to enter inside the Yankee cylinder.

The tubular entrance of the inspection apertures, furthermore, increases the structural stiffness of the head and therefore of the whole Yankee cylinder.

In particular, the hollow shaft mounted inside the cylindrical shell in a coaxial position has a substantially cylindrical shape. More precisely, each end of the hollow shaft is connected, for example by bolting, to a respective bearing journal.

Advantageously, a first bearing journal that is fixed to the first head and a second bearing journal that is fixed to the second head are provided.

In particular, an end of each bearing journal is housed, in use, in a hole of a respective end del hollow shaft. Furthermore, each bearing journal can comprises a respective portion that is mounted inside a bearing. Each end of the hollow shaft and the bearing journal that is connected to the same is, then, fixed to a respective head at respective fixing holes.

More precisely, each bearing journal is fixed by means of screw bolts both to a respective head and to a respective end of the hollow shaft.

BRIEF DESCRIPTION OF THE DRAWINGS

The invention will be now shown with the following description of its exemplary embodiments, exemplifying but not limitative, with reference to the attached drawings in which.

DETAILED DESCRIPTION OF THE INVENTION

Figure 1:
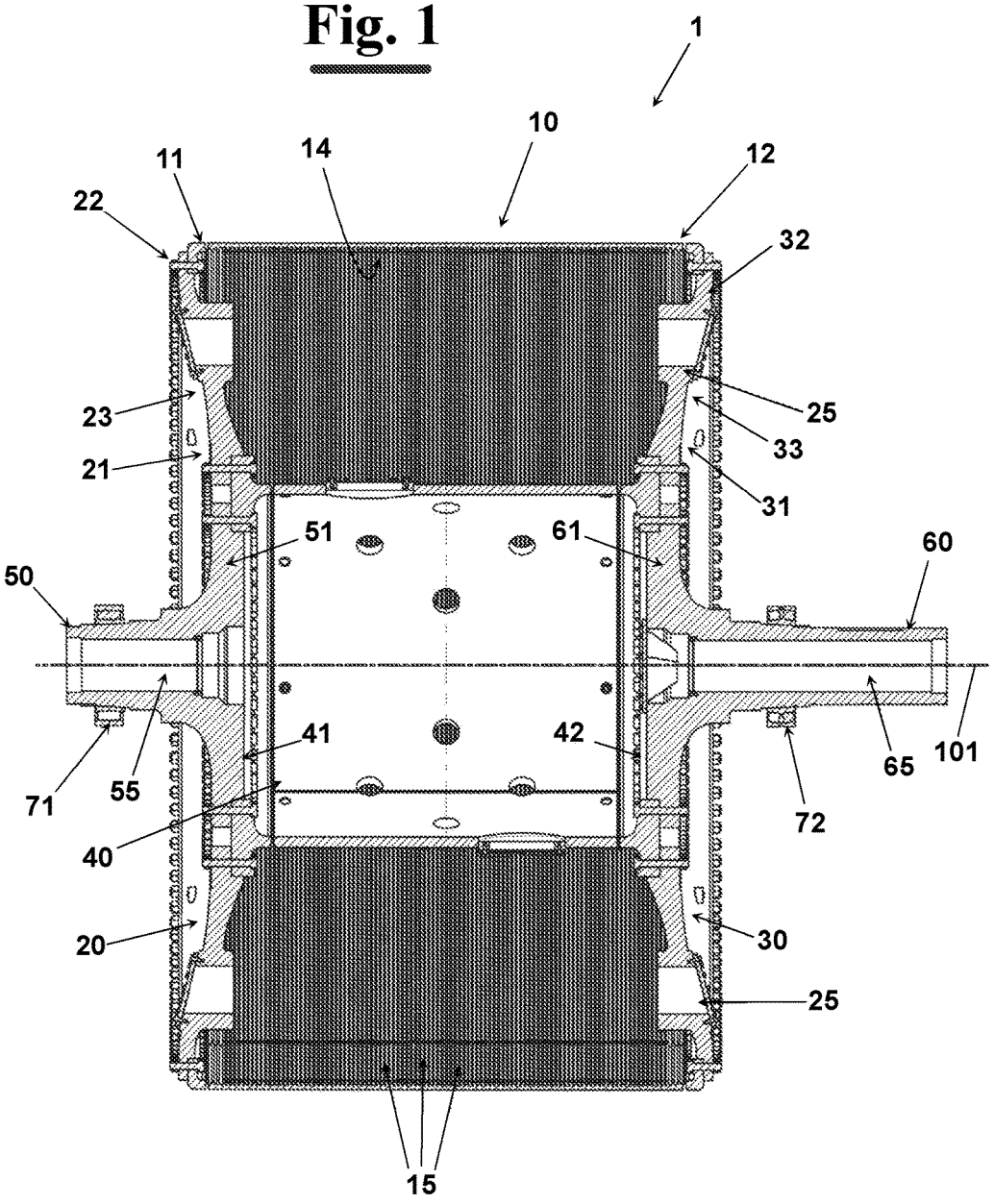
FIG. 1 diagrammatically shows in a view according to a longitudinal section, one of the possible embodiments provided for a Yankee dryer cylinder of mixed type steel and cast iron that can be produced using the cast iron, according to the invention.

As diagrammatically shown in FIG. 1, a possible structure of Yankee dryer cylinder 1, according to the present invention, comprises a cylindrical shell made of steel 10 having a longitudinal axis 101, a first head, or end wall, 20 and a second head, or end wall 30. In the embodiment of FIG. 1, each head 20, 30 has a central portion 21, 31 lowered towards the inside of the Yankee dryer cylinder 1, and an end portion 22, 32 that is connected to the respective lowered central portion 21, 31 through a connection portion 23, 33.

The cylindrical shell 10 is provided, in particular at the internal surface 14, with a plurality of circumferential grooves 15 having a predetermined depth. As known, the condensate that is formed for the transfer of the latent heat of vaporization from the steam, that has been introduced in the Yankee dryer cylinder 1, towards the outside, is collected inside the grooves 15.

The 2 heads 20 and 30 are fixed by means of a bolting to the shell 10 at the opposite ends 11 and 12.

The Yankee dryer cylinder 1 comprises, furthermore, a first bearing journal 50 and a second bearing journal 60 that are fixed at the opposite ends of a hollow shaft 40.

The fixing of the bearing journals 50 and 60 to the hollow shaft 40 is carried out by means of screw bolts. The ends 51 and 61 of the bearing journals 50 and 60 are respectively housed, in use, in the holes 41 and 42 of the hollow shaft 40 and have respective portions 55 and 65 mounted inside respective bearings 71 and 72. Each end 41 and 42 of the hollow shaft 40 is, furthermore, fixed to a respective head 20 and 30 by means of screw bolts.

As diagrammatically shown in the example of FIG. 1, for safety reasons, 2 inspection apertures 25 are provided at each head.

According to the present invention, the shell 10 is made of steel, preferably SA-516-70 steel with reference to the ASME nomenclature, whilst the first and the second head 20 and 30 are made of cast iron having the following composition by weight %: C: between 3.0 and 3.5%, Si: between 1.5 and 2.7% Mn: between 0.3 and 0.7%, P: between 0.05 and 0.10%, V: between 0.20 and 0.50%, S: between 0.05 and 0.10%, Mg: between 0.06 and 0.20%, Cu: between 0.10 and 0.80%, Cr: between 0.05 and 0.10%. This particular type of cast iron, more precisely of spheroidal cast iron, named SA-476-80 with reference to the ASME nomenclature, shows, as will be discussed in detail later on, a trend of the linear thermal expansion that is very similar to that one of the steel that is used for the shell 10 (see in this respect FIG. 2). In a particular particularly advantageous embodiment, also the bearing journals 50 and 60 and the hollow shaft 40 are made of the same cast iron of the heads 20 and 30, i.e. the spheroidal cast iron having the above indicated composition.

In the following some experimental data are shown that demonstrate that the cast iron, according to the present invention, hereafter "Cast iron-80", having the composition indicated in the following table 1, has a volumetric answer with respect to the temperature that is similar to that of the steel.

TABLE 1 qualitative and quantitative chemical composition of Cast iron-80

| Element | Chemical Symbol | Intervals of composition by weight (%) |
|---|---|---|
| Carbon | C | 3.0-3.5 |
| Silicon | Si | 1.5-2.7 |
| Manganese | Mn | 0.3-0.7 |
| Phosphor | P | 0.05-0.10 |
| Vanadium | V | 0.20-0.50 |
| Sulphur | S | 0.05-0.10 |
| Magnesium | Mg | 0.06-0.20 |
| Copper | Cu | 0.10-0.80 |
| Chromium | Cr | 0.05-0.10 |

In particular, it has been carried out a comparative analysis of the samples of "Cast iron-80" (sample 1 of tab.2), with samples made of steel (samples 3 and 4 of tab. 2) and with samples of a different type of cast iron, in the following "Cast iron-60" (sample 2 in tab. 2).

The materials have been sampled in a cylindrical shape with a length of 10 mm and an area of 25.5 $mm^2$.

TABLE 2

Description of the samples of cast iron and steel examined in respect of the thermal expansion.

| Sample | Type | Nickname | ASME corrispondente |
|---|---|---|---|
| 1 | Spheroidal cast iron-80% ferrite | 1-Cast iron80 | SA-476-80 |
| 2 | Cast iron-60% ferrite | 2-Cast iron60 | — |

TABLE 2-continued

Description of the samples of cast iron and steel examined in respect of the thermal expansion.

| Sample | Type | Nickname | ASME corrispondente |
|---|---|---|---|
| 3 | Sample B-normalized steel-direction orthogonal to rolling | 3-Ac-NormB | SA-516-70 |
| 4 | Sample A-normalized steel-direction orthogonal to rolling | 4-Ac-NormA | SA-516-70 |

The results of the measure of the linear thermal expansion coefficients of the samples made of cast iron and steel that are shown in table 1 have been measured in the range of temperature of 45-245° C.

Figure 2:
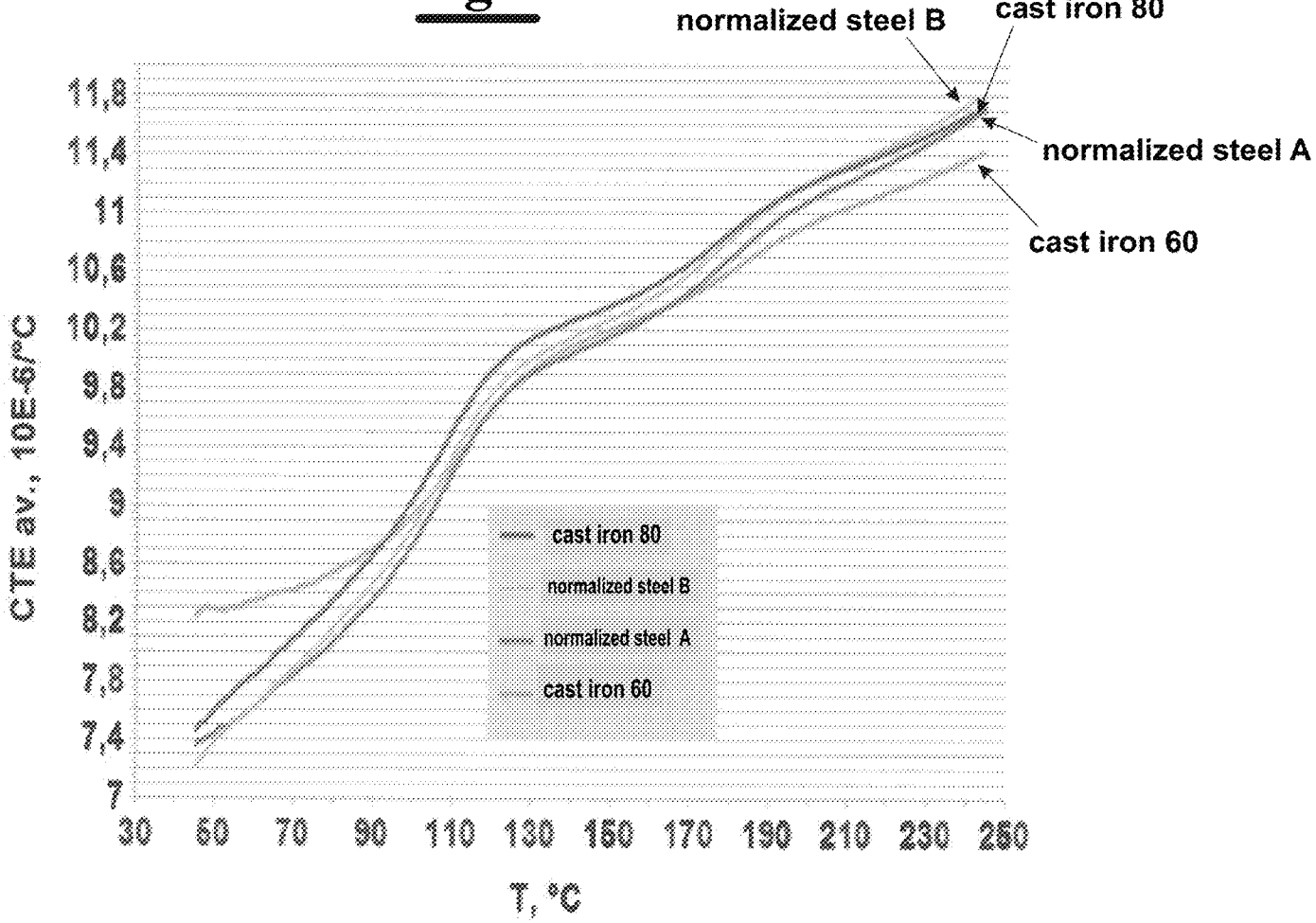
FIG. 2 diagrammatically shows, in the range of temperatures of interest, the trend of the coefficients of linear thermal expansion for the examined samples, i.e. a sample made of cast iron according to the invention, a sample made of a different type of cast iron and 2 samples made of steel.

The results obtained are shown in the graph of FIG. 2.

All the samples show a trend of the linear thermal expansion coefficient that increases with the temperature.

The trend is not rectilinear, but there are some regions of differentiated temperatures. In fact, the increasing with the temperature is much higher from 45 to 120° C. and then decreases in the range of 120-245° C.

In general all the materials show similar trends and not very different values with the only exception of sample 2 (Cast iron 60) that shows a higher expansion coefficient (up to about 10%) in the zone from 50 to 90° C.

The average values of the thermal expansion coefficients have been computed and indicated in table 3.

Analysing these values we have an indication of the different behaviour of the thermal expansion between cast iron and steel that in the samples that have been examined is overall very low.

In fact although the cast irons, in all the range that has been examined, have an expansion that is proportionally higher than the expansion of the steels, the differences in the average values lambda are always low in the change of the first decimal, with linear changes comprise between 1 and 2%. A higher interest is however raised by the composition of CAST IRON 80 the thermal expansion curve of which well approximate the curve of the samples made of steel in the whole range of temperature that has been examined.

TABLE 3 average coefficients of thermal expansion of the samples made of cast iron and steel in different ranges of temperature

| Sample | Nickname | corresponding ASME | $\lambda \cdot 10^6$ 45 ÷ 245° C. | $\lambda \cdot 10^6$ 45 ÷ 200° C. | $\lambda \cdot 10^6$ 100 ÷ 200° C. |
|---|---|---|---|---|---|
| 1 | 1-Cast iron80 | SA-476-80 | 10.14 | 9.73 | 10.30 |
| 2 | 2-Cast iron 60 | — | 10.01 | 9.65 | 10.46 |
| 3 | 3-Ac-NormB | SA-516-70 | 10.05 | 9.60 | 10.21 |
| 4 | 4-Ac-NormA | SA-516-70 | 9.95 | 9.50 | 10.10 |

It has been also determined the behaviour of the volumetric expansion of Cast iron-80, that has shown good performances as linear expansion.

The volume expansion coefficient of volume psi can be approximately computed as the triple of the linear one, that is:

$$Psi=3\cdot\lambda$$

And therefore the volumetric expansion of volume V0 of the material from temperature T1 to temperature T2 (with T2>T1) is:

$$Vt-V0=3V0\cdot\lambda(T2-T1)$$

and the percentage variation:

$$\Delta V\,\%=100(Vt-V0)/V0=3\cdot100\lambda(T2-T1)$$

TABLE 4 volumetric change in the samples of Table 1 with respect to temperature

| Sample | nickname | Corresponding ASME | ΔV % 45 ÷ 245° C. | ΔV % 45 ÷ 200° C. | ΔV % 100 ÷ 200° C. |
|---|---|---|---|---|---|
| 1 | 1-Cast iron80 | SA-476-80 | 0.6 | 0.45 | 0.31 |
| 3 | 3-Ac-NormB | SA-516-70 | 0.6 | 0.45 | 0.30 |
| 4 | 4-Ac-NormA | SA-516-70 | 0.59 | 0.45 | 0.30 |

As we can see from the data shown in table 4, in all the ranges of temperature that have been examined the volumetric changes are very low and practically equal to the innovative Cast iron-80 according to the present invention and the steels that have been examined.

In particular in the temperature range comprises between 100 and 200° C. the volumetric changes are only of 3%.

The data above shown and discussed demonstrate that the cast iron, according to the present invention, shows a volumetric expansion vs. the temperature that is very similar to that of the steel. Therefore, a difference of the cast irons that are normally used in the state of the art for producing mixed Yankee cylinders made of steel and cast iron, the use of the cast iron, according to the invention, allows to avoid problems of stability and working, in the zones of contact between the parts made of steel and the parts made of cast iron, when the Yankee dryer cylinder is subjected to thermal stresses.

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. Yankee dryer cylinder (1) comprising:

a cylindrical shell made of steel (10) having a first end (11) and a second end (12) opposite to said first end (11), said cylindrical shell (10) having a longitudinal axis (101) and being, furthermore, provided with a plurality of circumferential grooves (15);

a first head (20), or first end wall, fixed to said first end (11) of said cylindrical shell made of steel (10), said first head (20) being made of cast iron;

a second head (30), or second end wall, fixed to said second end (12) of said cylindrical shell made of steel (10), also said second head (20) being made of cast iron;

a hollow shaft (40) mounted inside said cylindrical shell (10) and connected to said first and to said second head (20,30) at a first and a second end (41,42), respectively;

a first bearing journal (50) fixed to said hollow shaft (40) at said first end (41);

a second bearing journal (60) fixed to said hollow shaft (40) at said second end (42);

wherein said cast iron in which said first and said second head (20,30) are made has the following composition by weight %:

C: between 3.0 and 3.5%;
Si: between 1.5 and 2.7%;
Mn: between 0.3 and 0.7%;
P: between 0.05 and 0.10%;
V: between 0.20 and 0.50%;
S: between 0.05 and 0.10%;
Mg: between 0.06 and 0.20%;
Cu: between 0.10 and 0.80%;
Cr: between 0.05 and 0.10%.

2. Yankee dryer cylinder, according to claim 1, wherein said hollow shaft (40) is made of a cast iron having the same composition by weight % of said cast iron of said first and said second head (11,12).

3. Yankee dryer cylinder, according to claim 1, wherein said first and said second bearing journal (31,32) are made of a cast iron having the same composition by weight % of said first and said second head (11,12).

4. Yankee dryer cylinder, according to claim 1, wherein each of said first and of said second head (20,30) comprises:

a central portion (21,31) that is lowered towards the inside of said Yankee dryer cylinder (1);

an end portion (22,32) connected to said central lowered portion through a connection portion (23,33).

5. Yankee dryer cylinder, according to claim 4, wherein said connection portion is substantially flat.

6. Yankee dryer cylinder, according to claim 1, wherein said hollow shaft (40) that is mounted coaxially inside said cylindrical shell (10) has a substantially cylindrical shape.

7. Yankee dryer cylinder, according to claim 1, wherein each end (41,42) of said hollow shaft (40) is connected by means of screw bolts to a respective bearing journal (50,60).

8. Yankee dryer cylinder, according to claim 1, wherein an end of each bearing journal (50,60) is housed, in use, in a respective hole of a respective end (41,42) of said hollow shaft (40), each bearing journal (50,60) being provided with a respective portion (55,65) mounted within a respective bearing (71,72).

* * * * *